US009821922B2

(12) United States Patent
Haimi

(10) Patent No.: US 9,821,922 B2
(45) Date of Patent: Nov. 21, 2017

(54) DEVICE AND METHOD FOR ATMOSPHERE MODIFICATION IN A CONTAINER DURING THE SEALING PROCESS

(71) Applicant: VP Sheets Ltd, Or Akiva (IL)

(72) Inventor: Shlomo Uri Haimi, Or Akiva (IL)

(73) Assignee: VP SHEETS LTD., Or Akiva (IL)

( * ) Notice: Subject to any disclaimer, the term of this patent is extended or adjusted under 35 U.S.C. 154(b) by 784 days.

(21) Appl. No.: 14/222,638

(22) Filed: Mar. 23, 2014

(65) Prior Publication Data

US 2015/0266600 A1 Sep. 24, 2015

(51) Int. Cl.
*B65B 31/06* (2006.01)
*B65B 7/28* (2006.01)
*B65B 31/04* (2006.01)

(52) U.S. Cl.
CPC ..... *B65B 7/2842* (2013.01); *B65B 31/046* (2013.01)

(58) Field of Classification Search
CPC ..... B65B 31/046; B65B 7/2842
See application file for complete search history.

(56) References Cited

U.S. PATENT DOCUMENTS 6,182,850 B1 * 2/2001 Marbler ..... B65D 77/225 220/359.3
6,912,828 B1 * 7/2005 Yamay ..... B65B 31/028 53/300
2005/0247593 A1 11/2005 Salvoni
2008/0175966 A1 * 7/2008 Kaufman ..... A23B 7/148 426/397
2013/0284738 A1 * 10/2013 Haimi ..... B32B 7/045 220/203.16

* cited by examiner

*Primary Examiner* — Andrew M Tecco
(74) *Attorney, Agent, or Firm* — Mark M. Friedman

(57) ABSTRACT

A method for atmosphere modification in a container during the sealing process that includes deploying a closure head on the container so as to enclose at least the container-opening and create an air-tight seal such that an interior volume of the closure head is isolated from the ambient atmosphere. The closure head having at least one conduit providing fluid communication between the interior volume and at least one of a vacuum source and a pressure source. The method also includes creating at least a partial vacuum inside the container, inserting a replacement atmosphere into the container by means of the pressure source, sealing the container; and removing the closure head from the container. Devices for implementing this method are also disclosed.

3 Claims, 16 Drawing Sheets

FIG. 5A
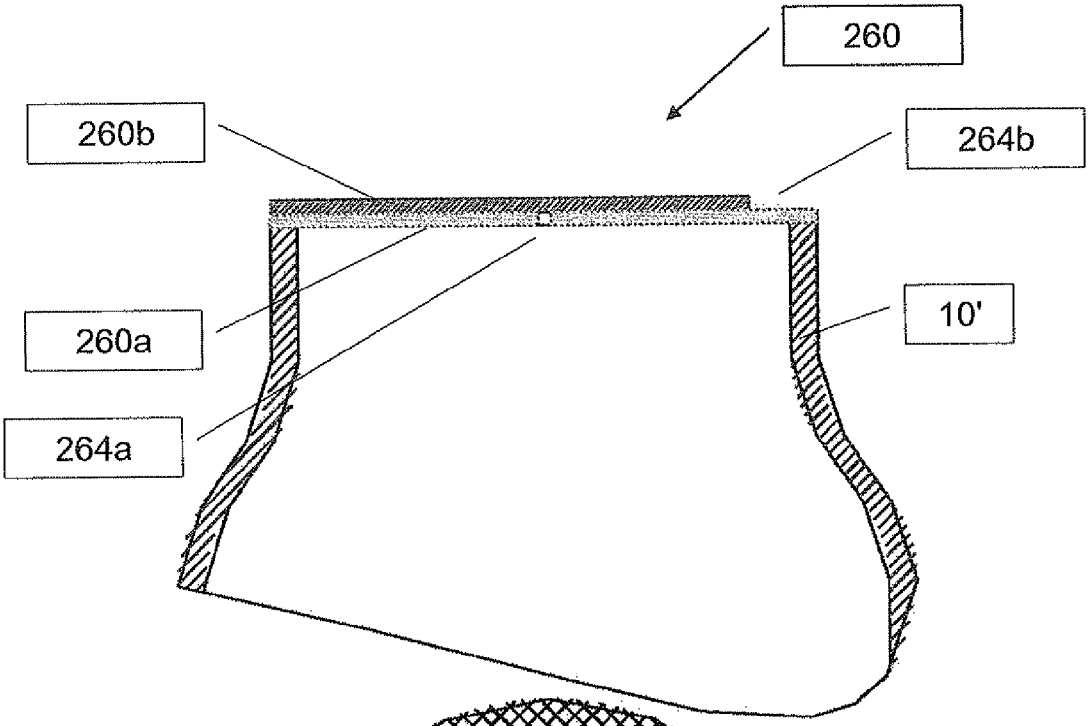
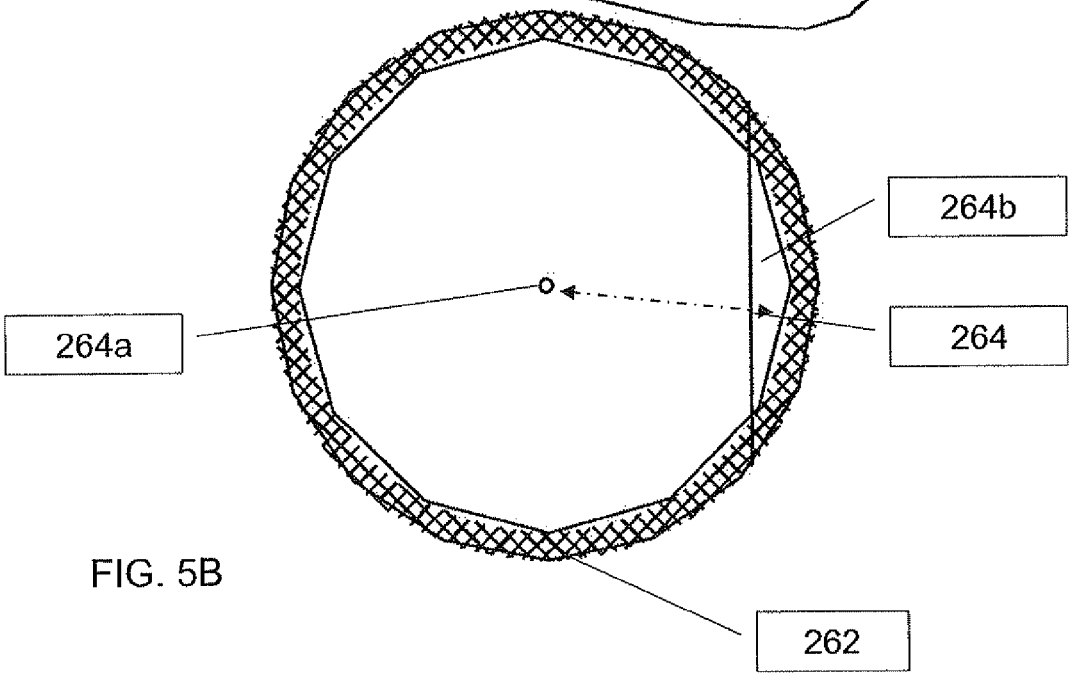
FIG. 5B

FIG. 6A
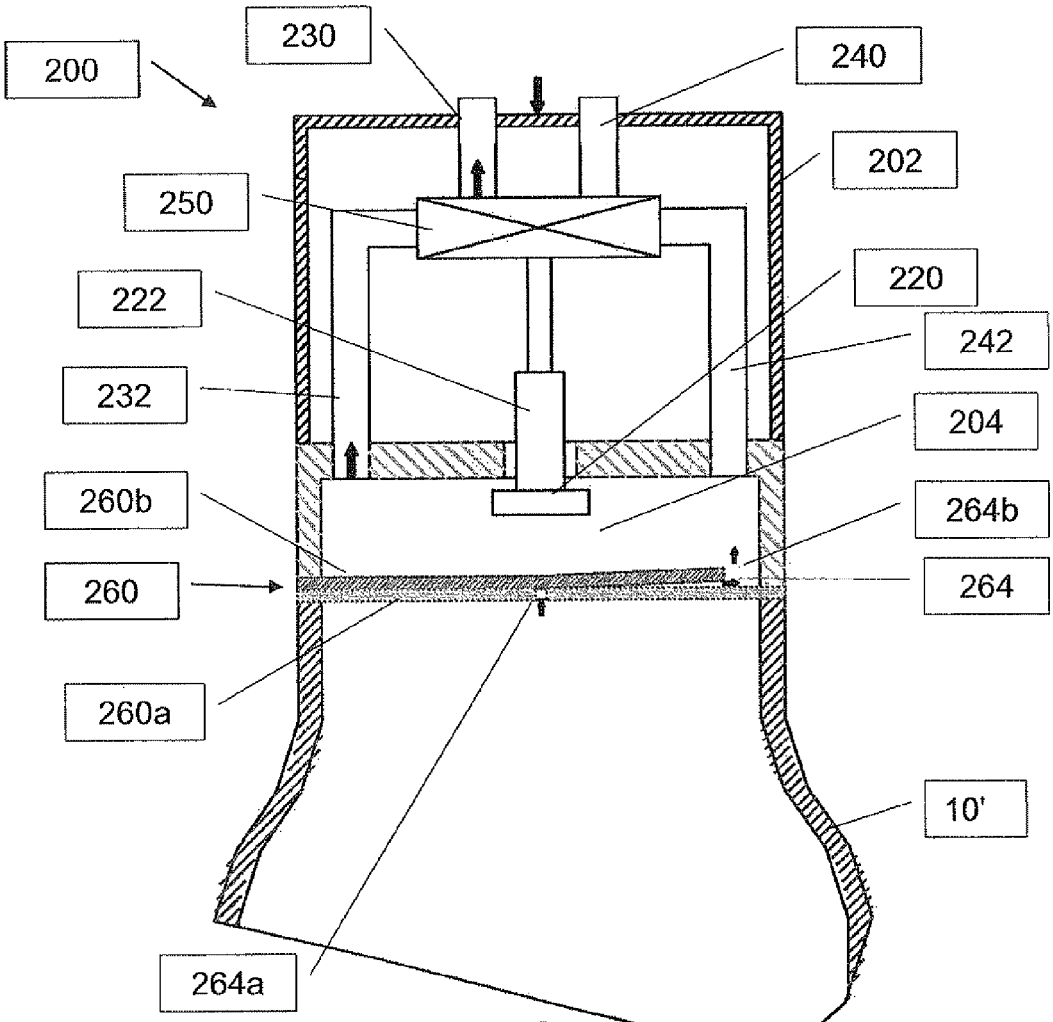
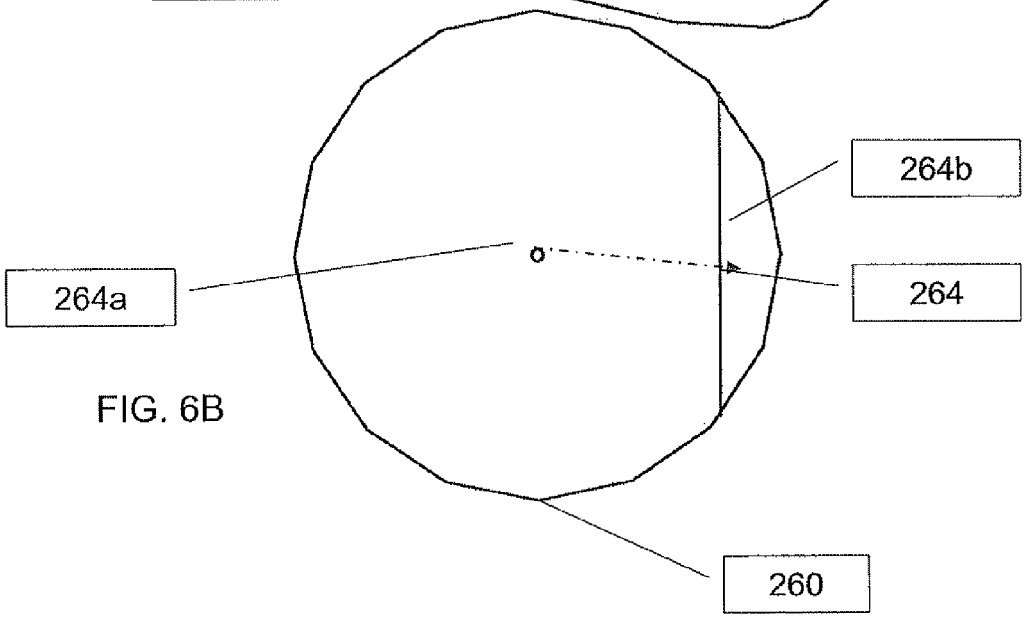
FIG. 6B

FIG. 7A
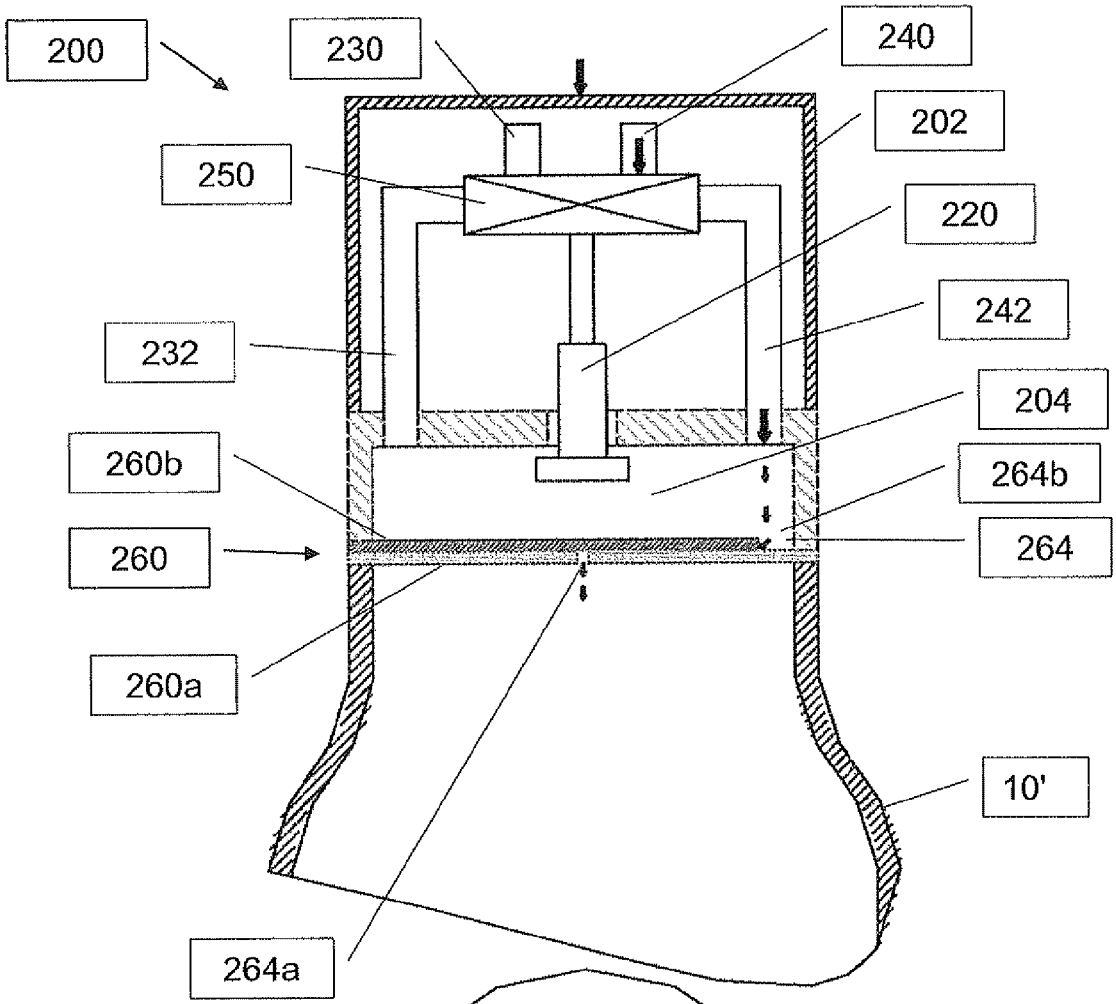
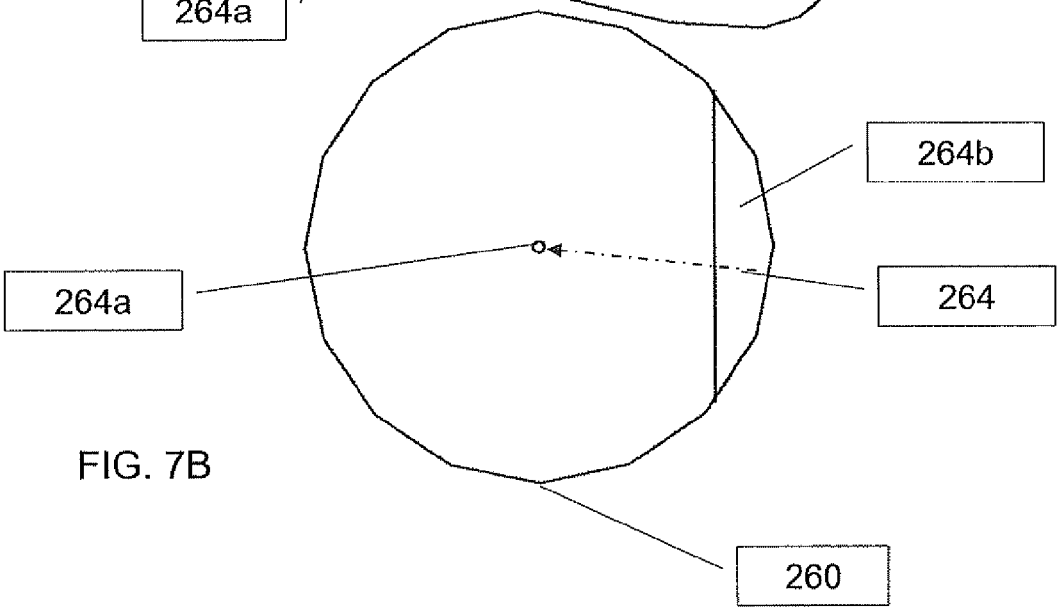
FIG. 7B

FIG. 9A
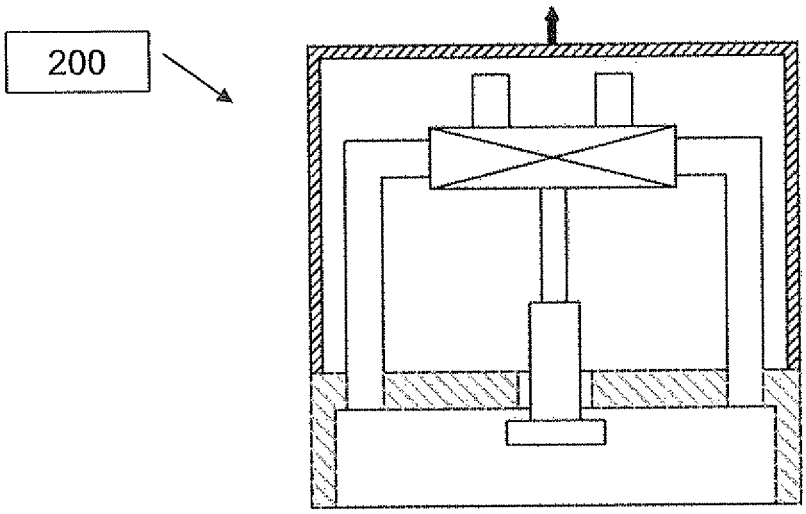
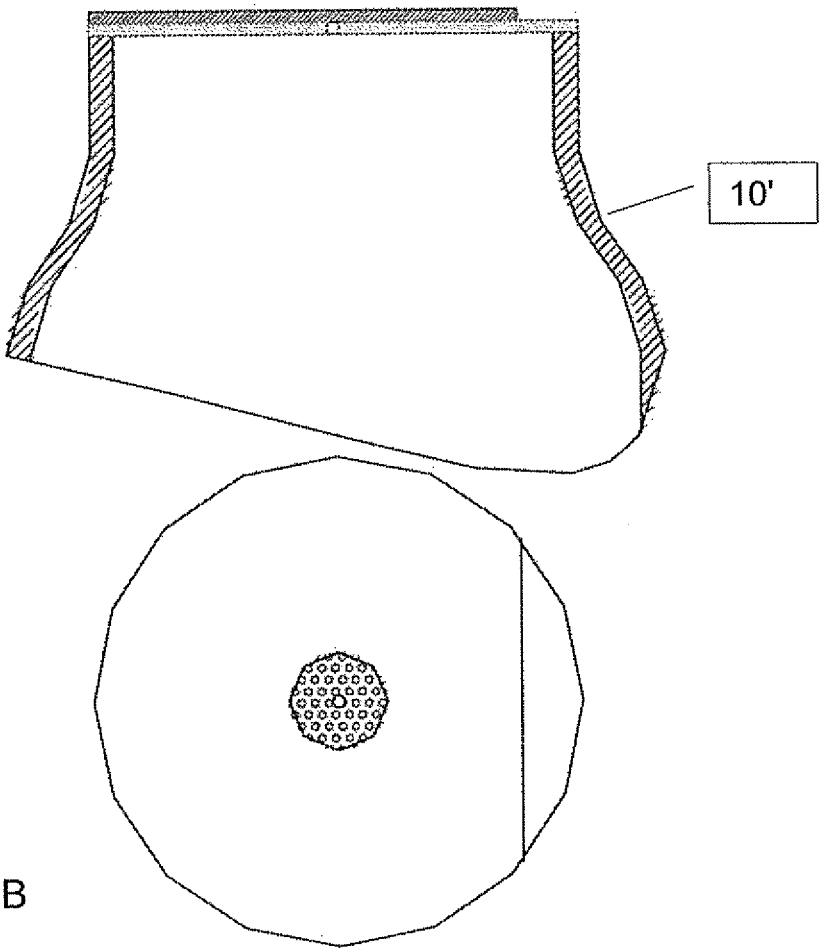
FIG. 9B

DEVICE AND METHOD FOR ATMOSPHERE MODIFICATION IN A CONTAINER DURING THE SEALING PROCESS

FIELD AND BACKGROUND OF THE INVENTION

The present invention relates to sealed containers and, in particular, it concerns a simpler, more convenient and less expensive device and method for atmosphere modification in a rigid container during the sealing process.

It is well-documented in the literature that air contains gases like oxygen (and/or other gases) as well as moisture that may harm and damage products, by causing and accelerating oxidization, spoilage, rotting, aroma loss, the loss of active materials, etc.).

Currently existing solutions to the problem of preserving products, such as medicine, foodstuffs, chemical substances and the like, include techniques such as the addition of oxygen absorbents, moisture absorbents, the creating of a vacuum, or the insertion of various inert gases. The use of moisture and oxygen absorbents is an expensive and difficult process. Creating a vacuum causes the package to collapse, while the insertion of inert gases (such as nitrogen) does not ensure the complete removal of all of the oxygen and moisture from the package.

Various techniques are used to create a vacuum or insert nitrogen and/or gases and other gaseous compounds to preserve products that are sensitive to air, moisture and/or oxygen, etc. However, the current techniques are relatively complex and expensive.

There is therefore a need for a simpler, more convenient and less expensive device and method for atmosphere modification in a rigid container during the sealing process.

SUMMARY OF THE INVENTION

The present invention is a simpler, more convenient and less expensive device and method for atmosphere modification in a rigid container during the sealing process.

According to the teachings of the present invention there is provided, a method for atmosphere modification in a filled container during the sealing process, the container having a container-opening for insertion and removal of contents of the container, the method comprising: (a) deploying a closure head on the container so as to enclose at least the container-opening, so as to create an air-tight seal such that an interior volume of the closure head is isolated from the ambient atmosphere, the closure head implemented so as to have at least one conduit in fluid communication between the interior volume and at least one of: (A) a vacuum source; (B) a pressure source; (b) creating at least a partial vacuum inside the container; (c) inserting a replacement atmosphere into the container by means of the pressure source; (d) sealing the container; and (e) removing the closure head from the container.

According to a further teaching of the present invention, there is also provided, implementing the closure head with a resilient container contact element configured to enhance the air tight seal.

According to a further teaching of the present invention, the deployment of the closure head brings the closure head into direct contact with the container.

According to a further teaching of the present invention, there is also provided, the steps of: (a) attaching a sealing element on the container, the container being implemented as a rigid container, so as to close the container opening prior to the deployment of the closure head, the sealing element configured with at least two layers so as to provide a passageway having at least a first opening open to the interior region of the container and at least a second opening open to the outside of the container, and deploying the closure head on the container so as to enclose at least the second opening; and (b) bonding together the least a portion of the at least two layers of the sealing element so as to close the passageway, thereby sealing the container.

According to a further teaching of the present invention, there is also provided, the closure head being implemented with a container-sealing mechanism configured to attach a sealing element to the container so as to seal the container-opening, such that the sealing the container includes operating the container-sealing mechanism, wherein the container being implemented as a rigid container.

According to a further teaching of the present invention, the container is implemented as a flexible container and the container-opening is sealed prior to deployment of the closure head and the deploying the closure head on the container is implemented as deployment of the closure head on the container so as to enclose at least an atmosphere replacement opening.

There is also provided according to the teachings of the present invention, a system for atmosphere modification in a container during the capping process, the container having a container opening for insertion and removal of contents of the container, the system comprising: (a) a sealing element configured for attachment on the container so as to at least close the container opening; (b) a closure head configured for deployment on the container so as to create an air-tight seal such that an interior volume of the closure head is isolated from the ambient atmosphere, the closure head including at least: (i) at least one conduit proving a fluid connection between an interior volume defined between the closure head and the container and least one of: (A) a vacuum pump; (B) a pressure pump; (ii) a control arrangement configured to control at least a flow of gas through the conduit so as to control at least one of: (A) atmosphere removal from the container; (B) atmosphere addition to the container, (iii) a bonding head configured to interact with at least the sealing element so as to fully seal the container opening with an airtight seal.

According to a further teaching of the present invention, the closure head is configured so as to directly contact with the container.

According to a further teaching of the present invention, and the container is as a rigid container and the a sealing element configured for attachment on the container subsequent to deployment of the closure head.

According to a further teaching of the present invention, the deployment of the closure head includes the contact with the container being an abutment to a side surface of the container so as to enclose at least the container opening in the interior volume defined between the closure head and the container.

According to a further teaching of the present invention, the closure head includes a resilient container contact element configured to enhance the direct contact with the container.

According to a further teaching of the present invention, the a sealing element is configured for attachment on the container prior to deployment of the closure head, so as to close the container opening without fully sealing it.

According to a further teaching of the present invention, and the container is as a rigid container and the sealing element is configured with at least two layers so as to provide a passageway having at least a first opening open to the interior region of the container and at least a second opening open to the outside of the container.

According to a further teaching of the present invention, the deployment of the closure head includes the contact with the container being an abutment to a top surface of a rim of the container opening so as to enclose at least the second opening in the interior volume defined between the closure head and the container.

According to a further teaching of the present invention, the interaction between the bonding head and the sealing element includes bonding together at least a portion of the at least two layers of the sealing element so as to close the passageway.

BRIEF DESCRIPTION OF THE DRAWINGS

The invention is herein described, by way of example only, with reference to the accompanying drawings, wherein:

FIGS. 5A and 5B are schematic side elevation and top view, respectively, of the container for use with a second preferred embodiment illustrated in FIG. 6A; the container shown with a seal element attached so as to close the container opening;

FIG. 6A is a schematic side elevation of a second preferred embodiment of a system for atmosphere modification in a rigid container during the sealing process constructed and operational according to the teachings of the present invention, shown here during the vacuum step of the atmosphere modification process;

FIG. 6B is a top view of the seal element of the embodiment of FIG. 6A;

FIG. 7A is a schematic side elevation of the embodiment of FIG. 6*a*, shown here during the atmosphere replacement step of the atmosphere modification process;

FIG. 7B is a top view of the seal element of the embodiment of FIG. 7A;

FIG. 9A is a schematic side elevation of the embodiment of FIG. 6*a*, after completion of the sealing process of the embodiment of FIG. 6A;

FIG. 9B is a top view of the seal element of the embodiment of FIG. 9A;

DESCRIPTION OF THE PREFERRED EMBODIMENTS

The present invention is a simpler, more convenient and less expensive device and method for atmosphere modification in a rigid container during the sealing process.

The principles and operation of a device and method for atmosphere modification in a rigid container during the sealing process according to the present invention may be better understood with reference to the drawings and the accompanying description.

By way of introduction, in its simplest form, the present invention includes a closure head that is configured to come into physical contact with the filled rigid container so as to isolate the container opening from the ambient atmosphere, modify the atmosphere within the container and then seal the container thereby maintaining the modified atmosphere with in the container.

Such atmosphere modification may include creating a vacuum state, a pressurized state or an atmosphere replacement within the container.

According to the teachings of the present invention, atmosphere replacement includes first creating a vacuum state within the container then introducing a replacement atmosphere such as, but not limited to nitrogen or another suitable inert gas. When sealing the container after introduction of the replacement atmosphere the pressure in the container may be less than, equal to or greater than the ambient air pressure once the closure head is removed.

The illustrations herein relate only to the closure head and it will be understood that the closure head of the present invention may be installed on any suitable capping machine. It will be appreciated that such capping machine may be designed specifically for use with the closure head of the present invention. Alternately, the closure head of the present invention may be installed on an existing capping machine as an upgrade to an existing container filling assembly line.

Definitions

The terms "inflexible containers" and "rigid containers" may be used interchangeably herein and refer to bottles, jars and other containers with hard sides. That is, packages that maintain durability and structural integrity under pressure above or below the ambient air pressure and other forces.

Figure 1:
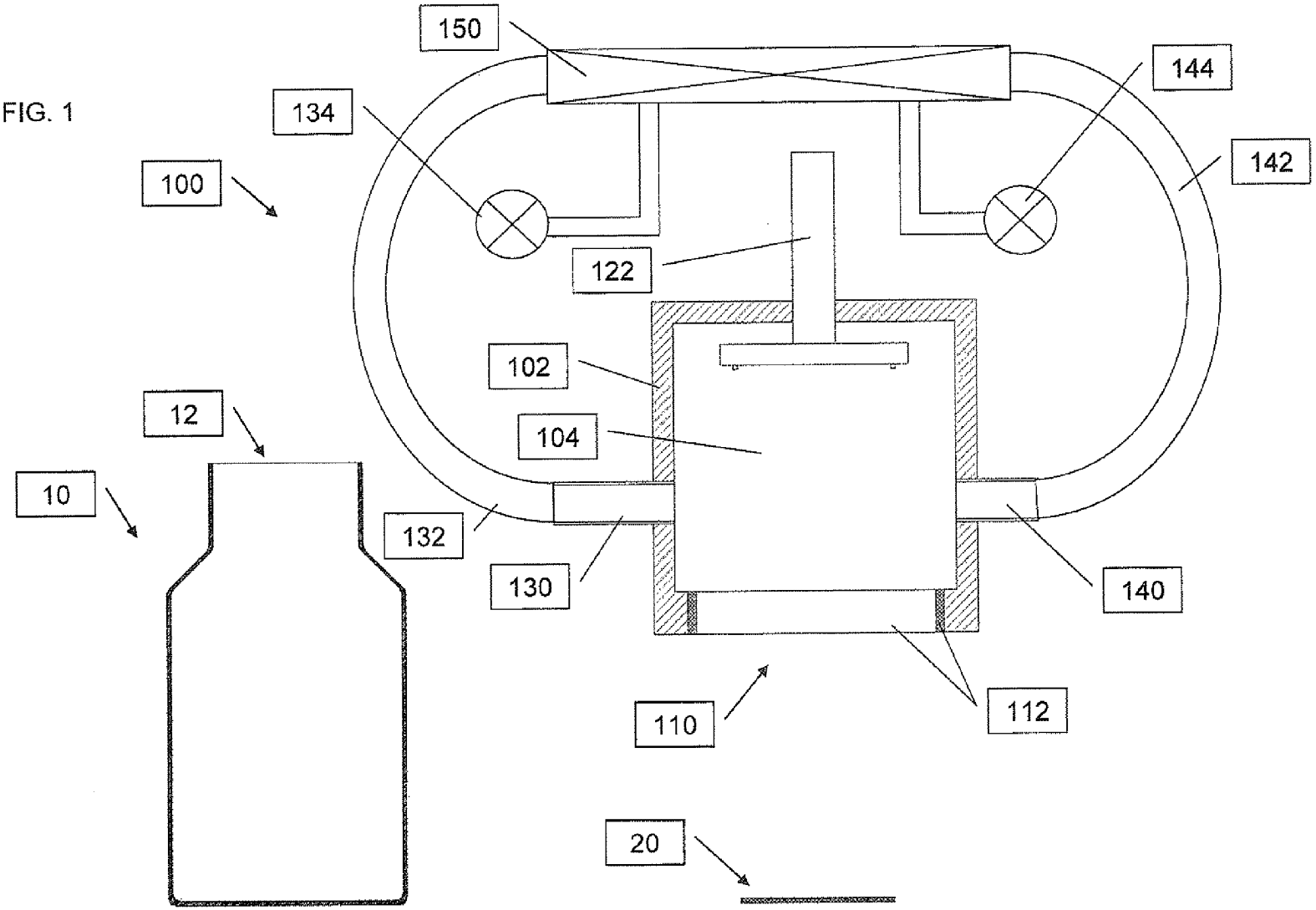
FIG. 1 is a schematic representation of a first preferred embodiment of a system for atmosphere modification in a rigid container during the sealing process constructed and operational according to the teachings of the present invention.

Referring now to the drawings, FIG. 1 illustrates a first preferred embodiment of closure head system 100 of the present invention in which the sealing element is configured for attachment on the container subsequent to deployment of the closure head. Also illustrated are non-limiting examples of a rigid container 10 and a non-permeable sealing element 20. Rigid container 10 is configured with a container-opening 12 for the insertion and removal of the contents to be stored in the container. Non-permeable sealing element 20 is configured for sealing rigid container 10 as will be described below.

Closure head system 100 includes a closure head housing 102 defining within it an interior volume 104. Closure head housing 102 is configured with a container receiving opening 110, an outlet port 130, an inlet port 140 and a container-sealing mechanism 122 configured with bonding head 120.

Figure 2:
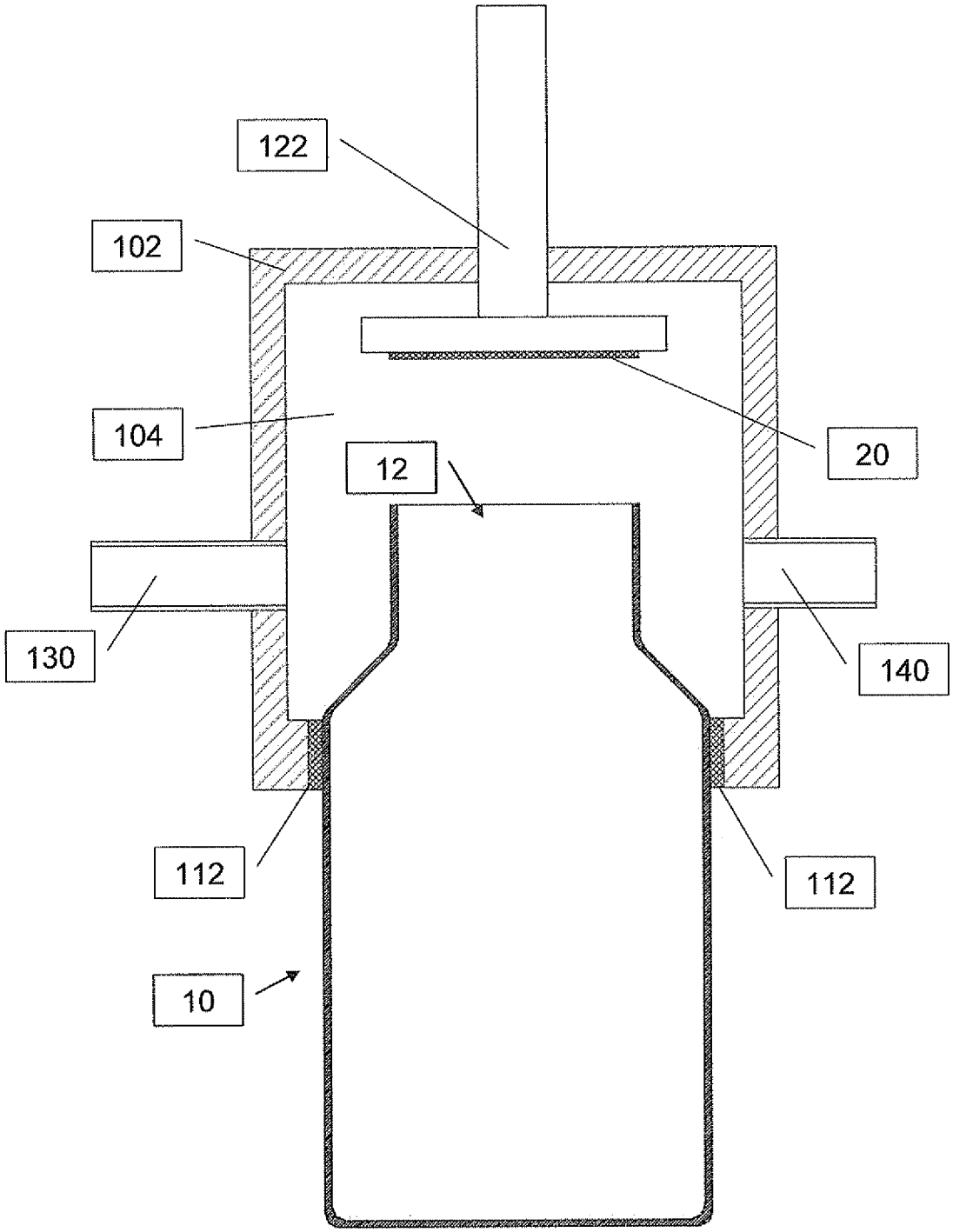
FIG. 2 is a schematic representation of the atmosphere modification process of the embodiment of FIG. 1.
Figure 3:
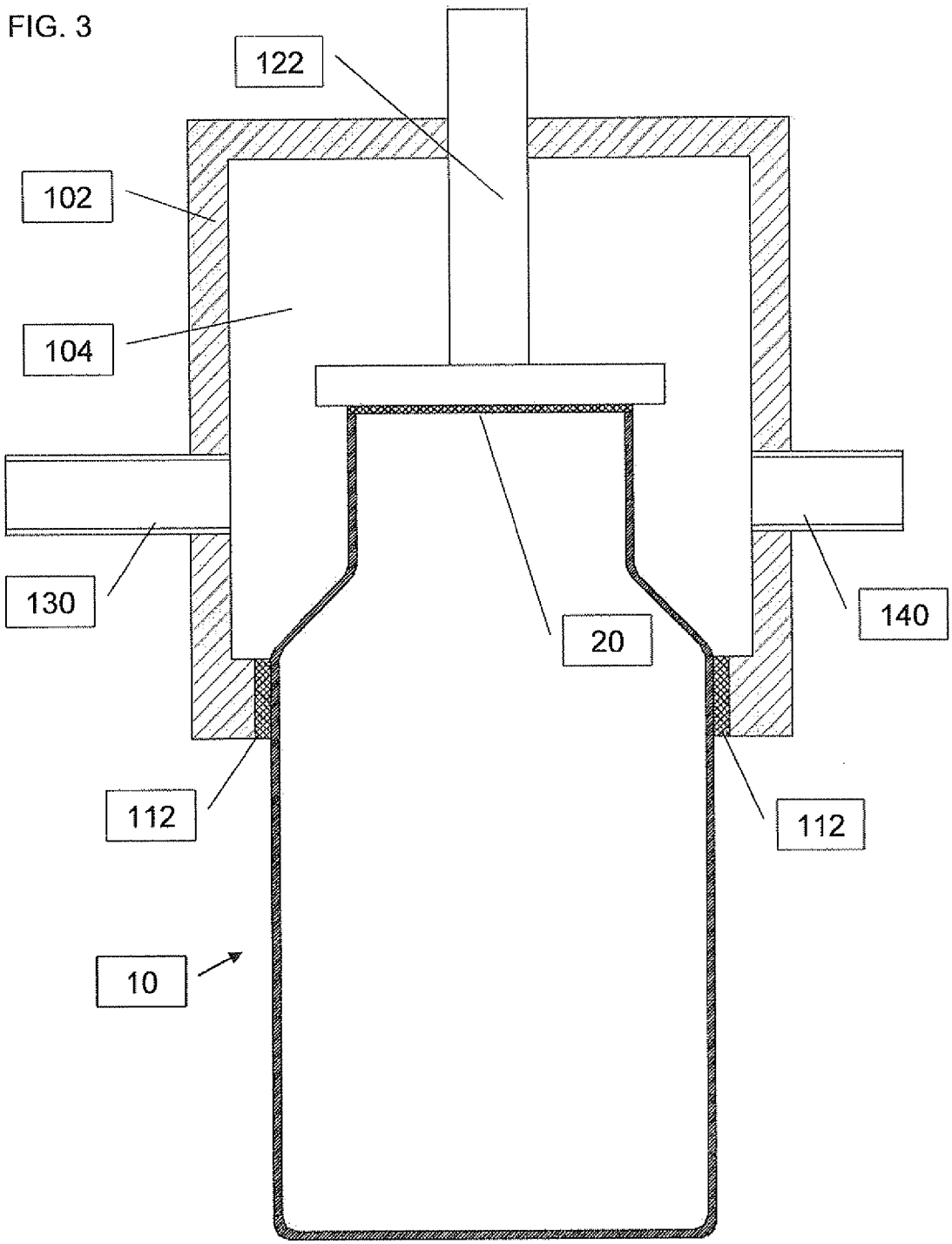
FIG. 3 is a schematic representation of the sealing process of the embodiment of FIG. 1.
Figure 4:
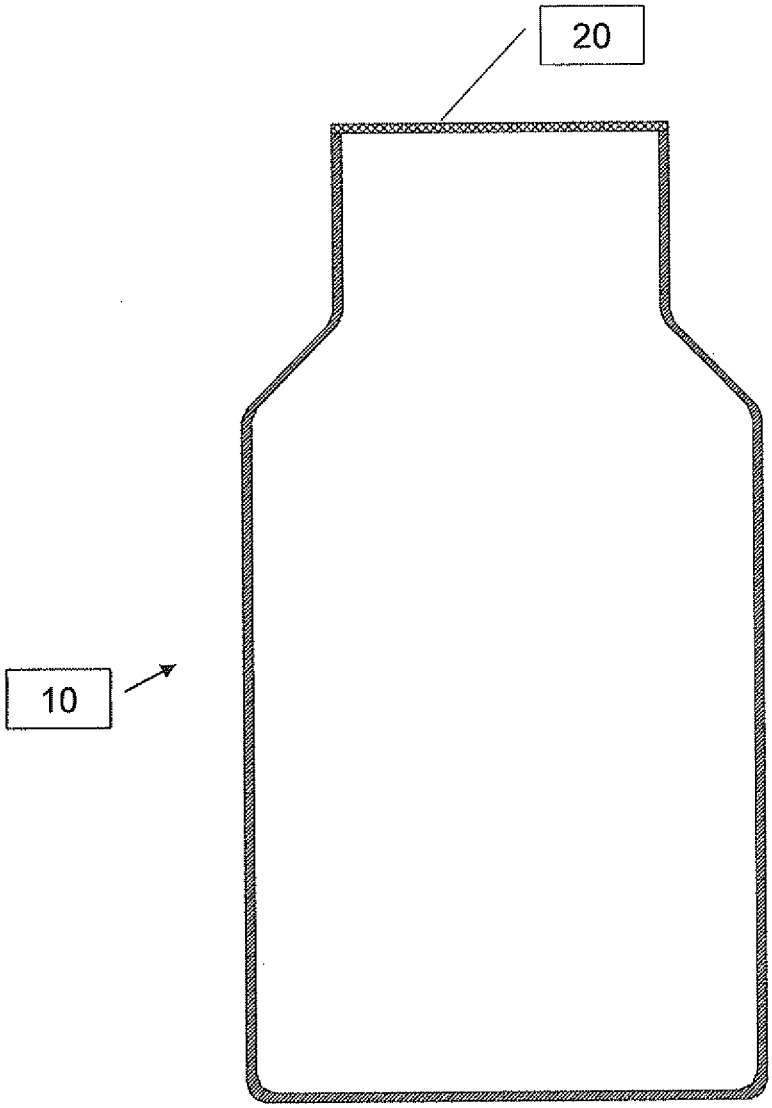
FIG. 4 is a schematic representation of container of FIG. 1 after completion of the sealing process of the embodiment of FIG. 1.

As seen in FIGS. 2 and 3, the contour of container receiving opening 110 is generally the same as the outer contour of at least a portion of container 10 so as to engage the container 10 during the container sealing procedure of the present invention such that said contact of the closure head 102 with the container 10 is an abutment to a side surface of the container 10 so as to enclose at least the container opening 12 in the interior volume 104. As illustrated here, the contour of container receiving opening 110 is generally the same as the outer contour of the body portion of container 10. However, this is a non-limiting example intend for illustrative purposes. It will be appreciated the container receiving opening 110 may be configured so as to engage container 10 in the neck region or at substantially any suitable region so long as the container-opening 12 in encased within closure head housing 102.

To further ensure an airtight seal between the container 10 and the closure head housing 102, the container receiving opening 110 may be fitted with a resilient container contact element 112 that is configured to contact the container 10 and thereby enhance the direct contact with the container.

By means of the outlet port 130 and conduit 132, interior volume 104 of the closure head housing 102 is in fluid communication with a vacuum pump 134. Likewise, by means of the inlet port 140 and conduit 142, interior volume 104 of the closure head housing 102 is in fluid communication with a pressure pump 144. It will be readily understood that conduit 142 may, alternatively or optionally, be connected to substantially any vacuum source such as, but not limited to, a vacuum chamber. Likewise, conduit 142 may, alternatively or optionally, be connected to substantially any pressure source such as, but not limited to, pressure pump or a pressurized chamber containing the atmosphere replacement gas.

As illustrated here, the fluid communication between the interior volume 104 of the closure head housing 102 may be controlled by a valve control unit 150. It will be understood that the valve control unit 150 may be implemented as substantially any suitable control arrangement. It will be appreciated that use of such a valve control unit is not necessarily require and that numerous options for controlling the fluid on gases in and out of the interior volume 104 of the closure head housing 102 would be considered within the scope of the present invention.

In operation, the system of FIG. 1 begins with a non-permeable sealing element 20 deployed on the bonding head 120. As an already filed container 10 moving along a capping line into a position that the closure head housing 102 is lowered over at least a portion of container 10, as illustrated in FIG. 2, thereby encasing the container-opening 12 and isolating it from the ambient atmosphere.

Air is them removed from the interior volume 104 of the closure head housing 102 via the outlet port 130. As illustrated here, such a process would entail operation of the vacuum pump 134 so as to draw the air through conduit 132. As soon as a predetermined amount of air has been removed the vacuum pump is stopped and the pressure pump 144 is activated so as to force a predetermined amount of atmosphere replacement gases through conduit 142 and the inlet port 140 into interior volume 104 of the closure head housing 102.

It should be noted that the air removal may, by non-limiting example, be determined by the vacuum pressure within interior volume 104 or simply by the length of time the vacuum pump 134 is operated. Likewise, the amount of atmosphere replacement gases may, by non-limiting example, be determined by the vacuum pressure within interior volume 104 or simply by the length of time the pressure pump 144 is operated. This is true for all embodiments of the present invention illustrated herein.

Once the process of atmosphere replacement is complete, bonding head 120 is lowered so as to attach the non-permeable sealing element 20 to container 10 so as to seal container-opening 12 of the container 10. Therefore, in this embodiment, the interaction between the bonding head 120 and the sealing element 20 includes attaching the sealing element 20 to container 10. After which, the closure head housing 102 is raised allowing the container 10 to continue along the assembly line.

FIGS. 5A-12B illustrate a second preferred embodiment of closure head system 200 of the present invention, as seen in FIG. 6A. In this embodiment, the prefilled rigid container 10' is first closed, but not sealed, with a flexible valve sheet 260 that is attached to container 10' the periphery 262 of its container-opening 12' prior to deployment of the closure head. Such attachment may be accomplished by substantially any means known in the art such as, but not limited to, welding or gluing.

The brief description of the valve sheet of FIGS. 5A-11 is offered here for convenience, as the sheet material itself is the invention disclosed in U.S. patent application Ser. No. 13/459,186, entitled "Sheet Material with Integrally Formed One-way Valve", to the same inventor and now incorporated herein in its entirety by this reference. The valve sheet 260 may be used to create a vacuum state, a pressurized state and/or atmosphere modification within the container 10'. The valve opening 264 is left in an always open status until sealed after the atmosphere modification procedure of the present invention is completed. The valve sheet 260 shown illustrated for conceptualization purposes only is comprised of two layers that are bonded together only along their peripheral edges. The bottom layer 260*a*, adjacent to the interior of the container 10', is configured with an opening 264*a*, while the top layer 260*b* does not fully cover the layer 260*a*, thereby leaving an opening 264*b*. In this construction gases may flow between the interior of the container and the outside of the container via the valve opening 264. However, this illustration is not intended as a limitation, but rather as a non-limiting example. It will be understood that the valve may be produced with as many layers as is required, and/or a different structure, i.e. a flexible and/or non-flexible valve sheet, as will be explained with regard to FIGS. 12A and 12B.

The closure head system 200 illustrated in FIG. 6A includes a closure head housing 202 defining within it an interior volume 204. Closure head housing 202 includes an outlet port 230, an inlet port 240 and a container-sealing mechanism 222 configured with a bonding head 220.

The closure head housing 202 is configured to contact the container 10' on the top edge of the periphery 262 of its container-opening 12'. Therefore, the first step in the method of the present invention is to lower closure head housing 202 until it is in contact with the container 10' on the top edge of the periphery 262 of its container-opening 12' in an airtight abutment.

In this deployment, the interior volume 204 of closure head housing 202 as well as the interior of container 10' are isolated from the ambient atmosphere and are in fluid communication via the valve opening 264 in valve sheet 260.

Another notable difference between this embodiment 200 and the embodiment of Figure is the placement of the valve control unit 250 inside the closure head housing 202. As in FIG. 1, outlet port 230 is in fluid communication with a vacuum pump (not shown). Likewise, the inlet port 240 is in fluid communication with a pressure pump (also not shown).

The atmosphere modification process of the system of FIG. 6A begins with the removal of air from the interior volume of container 10' and creating at least a partial state of vacuum by drawing the air out through conduit 232 and outlet port 230. As the air is drawing out of the interior volume 204 of closure head housing 202, the air is also drawn out of the interior of container 10' through valve opening 264. Also see FIG. 11.

At this stage, all or at least some of the air is removed from the container. If the objective of the atmosphere modification is to create a vacuum state within the container 10', outlet port 230 is closed by the valve control unit 250 and the valve opening 264 is sealed (as will be discussed below).

Figure 11:
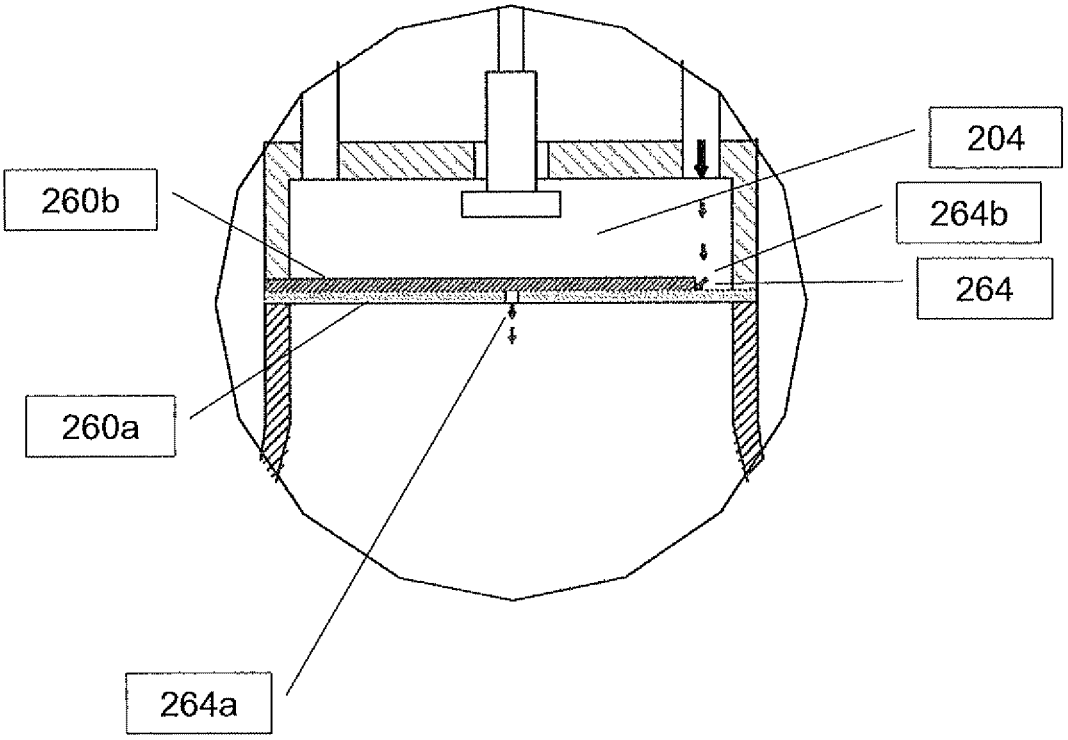

If, however, the objective of the atmosphere modification is to replace the atmosphere within the container 10', when a predetermined amount of air has been removed outlet port 230 is closed by the valve control unit 250 which then opens inlet port 240 so as to force a predetermined amount of atmosphere replacement gases through conduit 242, the into interior volume 204 of the closure head housing 202 and through valve opening 264 into the interior of container 10', as illustrated in FIGS. 7A and 11.

Figures 8A, 8B:
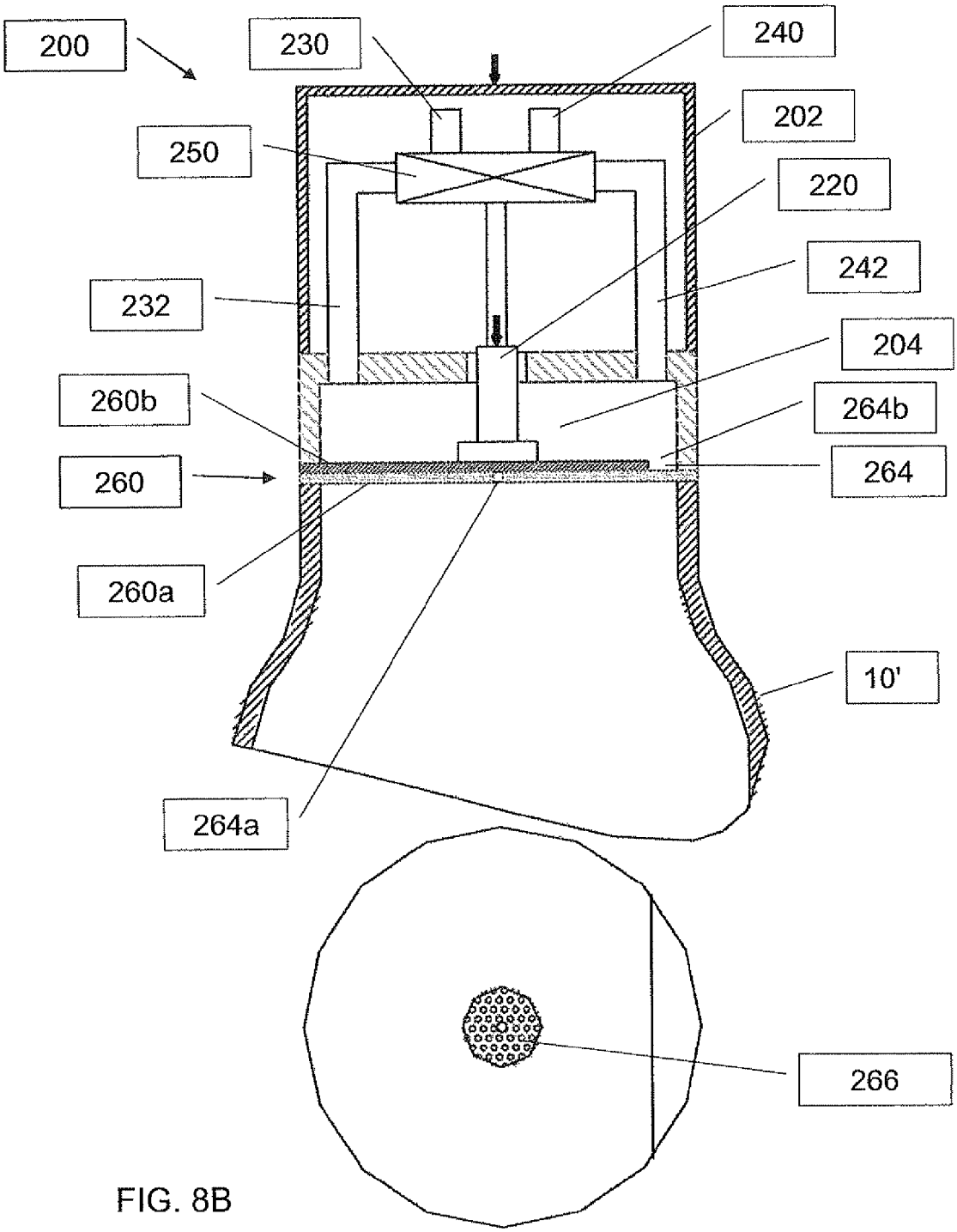
FIG. 8A is a schematic side elevation of the embodiment of FIG. 6*a*, shown here during the sealing step of the atmosphere modification process.
FIG. 8B is a top view of the seal element of the embodiment of FIG. 8A.
Figure 10:
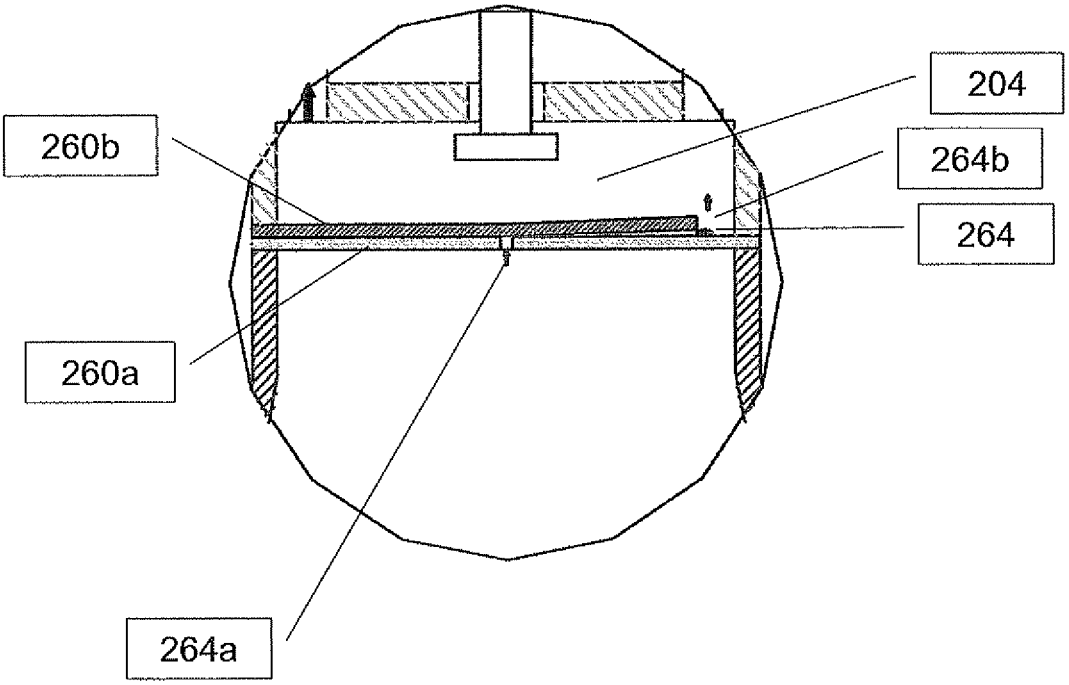
FIGS. 10 and 11 are details of the vacuum step and the atmosphere replacement step of the atmosphere modification process, respectively.

Once the desired atmosphere modification is completed, the valve control unit 250 closes inlet port 240 and bonding head 220 interacts with the valve sheet 260, by being brought into contact with the top layer 260*b* of valve sheet 260 so as to seal valve opening 264. By non-limiting example this is illustrated in FIGS. 8A and 8B as the fusing together of top lay 260*b* and the bottom layer 260*a* of valve sheet 260 in the area 266 directly surrounding opening 264*a* in bottom layer 260*a*. It will be appreciated, however, that substantially any manner of blocking the passage of gases through valve opening 264 is within the spirit of the present invention.

After the container 10' is fully sealed, the closure head housing 202 is raised allowing the now sealed container 10' to continue along the assembly line.

Figure 12A:
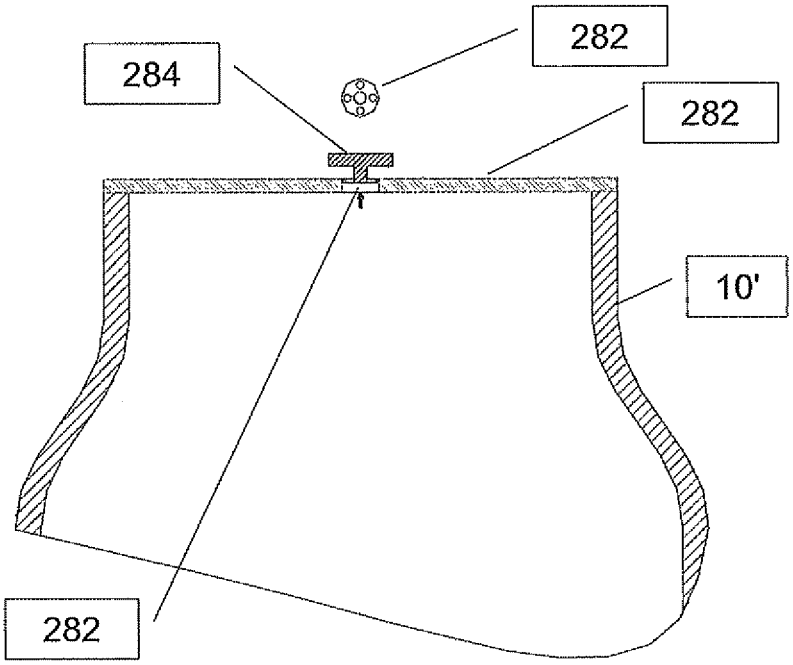
FIGS. 12A and 12B are schematic side elevations of a variant valve configuration for use with the embodiment of FIG. 6A.
Figure 12B:
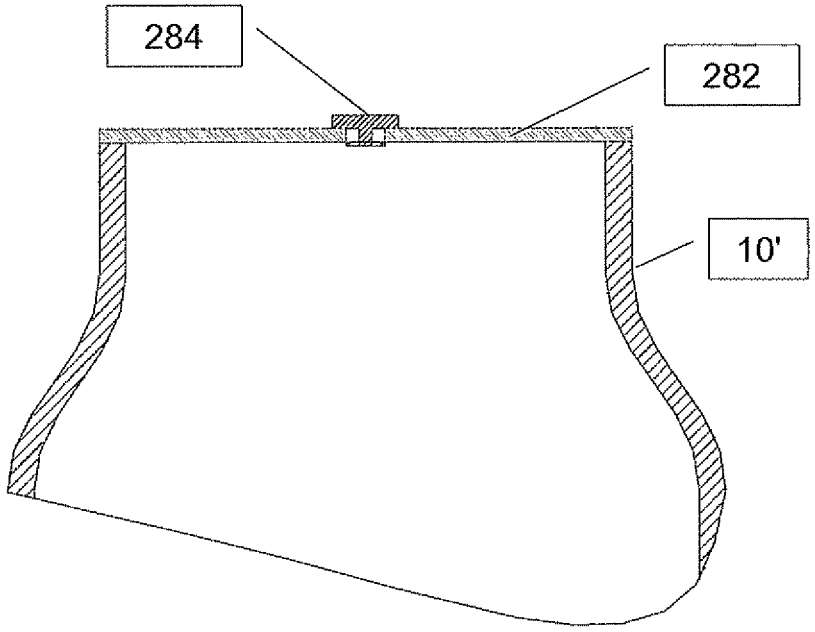

FIGS. 12A and 12B illustrate an alternative valve sheet 280 for use with the embodiment of FIG. 6A. Valve sheet 280 is configured as a single layer sheet that is preferably, but not necessarily, rigid or semi-rigid having a valve opening 262. A valve closure 284 associated with valve opening 282 is initially deployed in an always open arrangement. It will be readily understood that once the desired atmosphere modification is completed, the interaction between the bonding head 220 and valve closure 284 includes the bonding head 220 being lowered so as to press valve closure 284 closed and then seal it in place, as described above.

Figure 13:
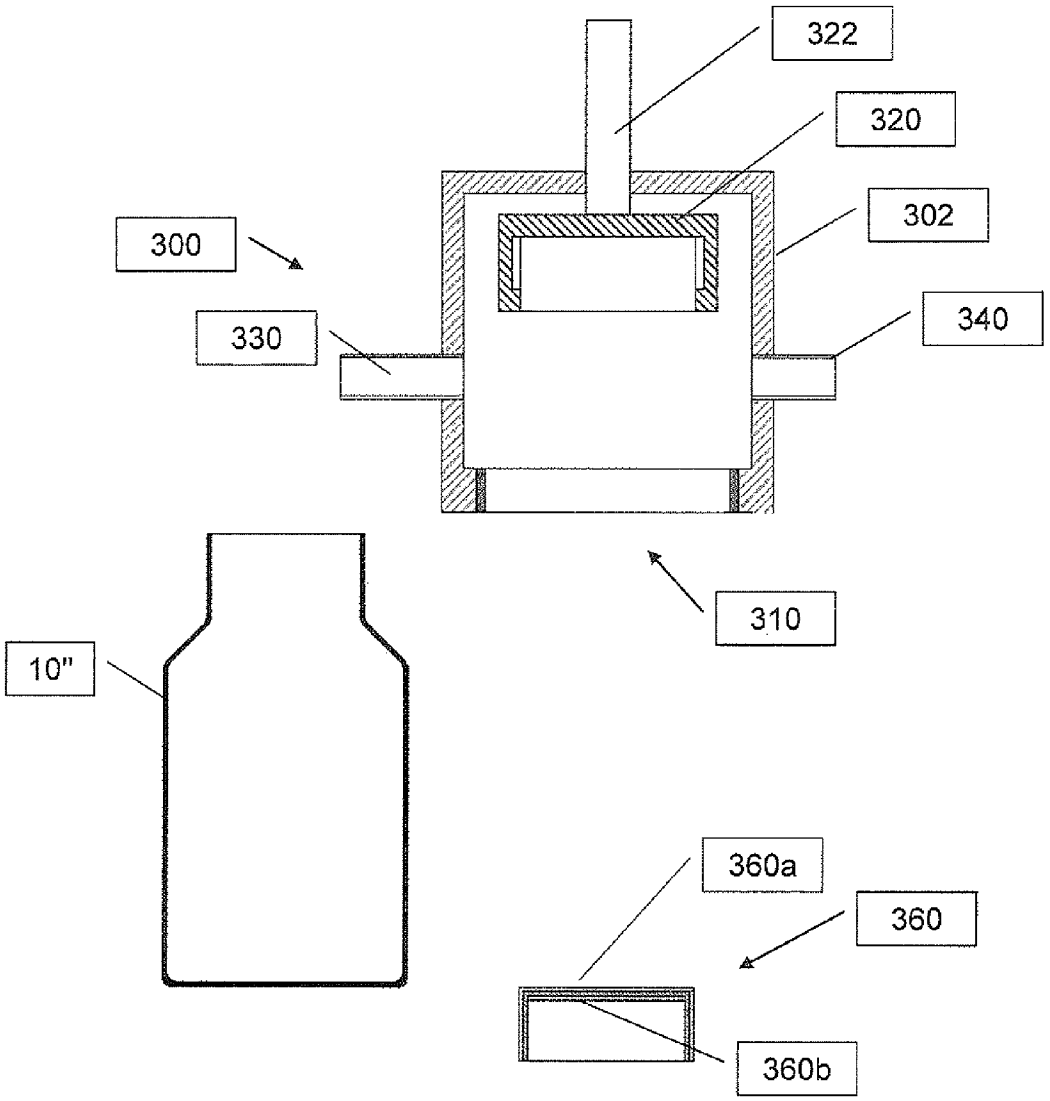
FIG. 13 is a schematic representation of a third preferred embodiment of a system for atmosphere modification in a rigid container during the sealing process constructed and operational according to the teachings of the present invention.
Figure 14:
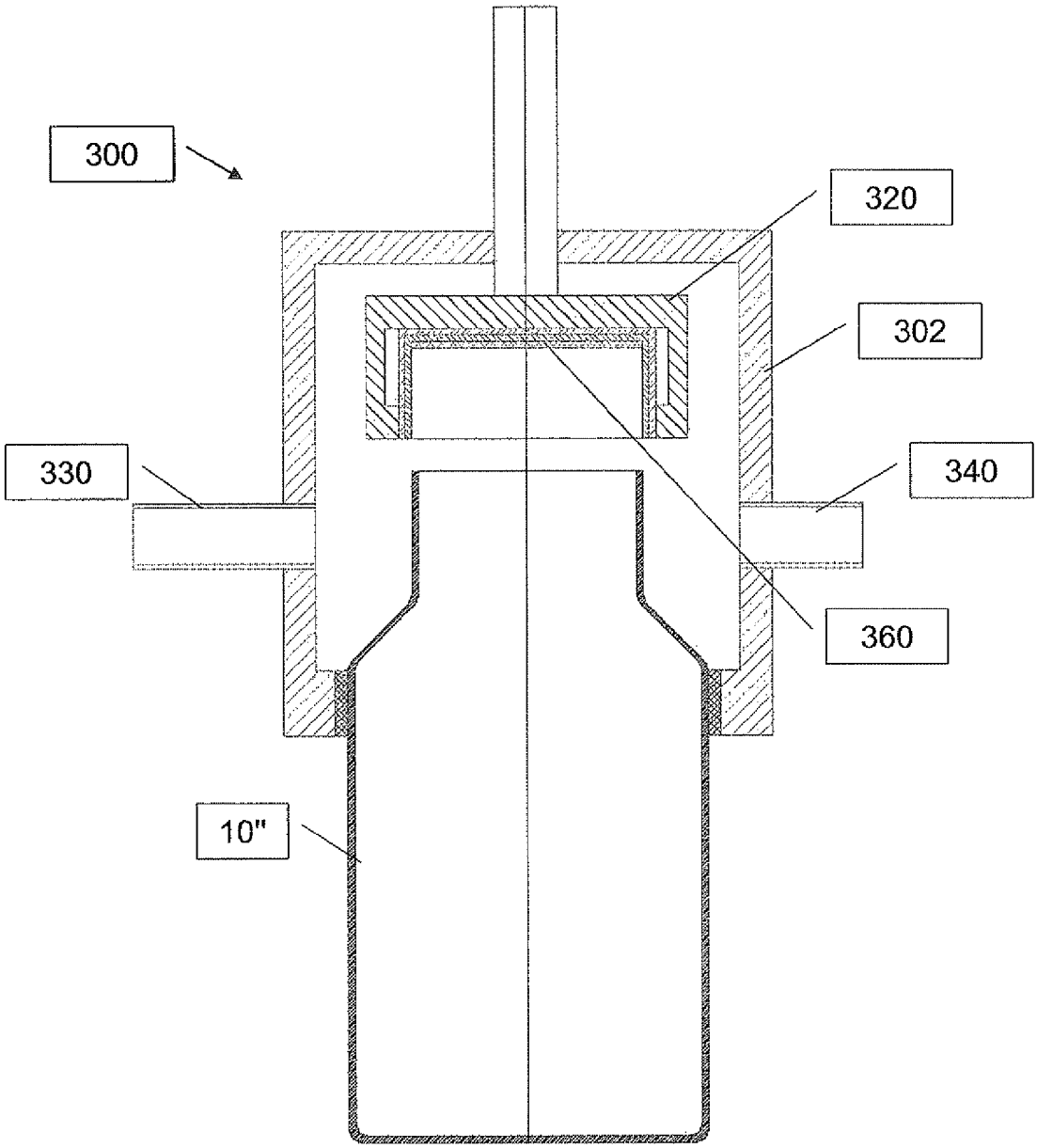
FIG. 14 is a schematic representation of the atmosphere modification process of the embodiment of FIG. 13.
Figure 15:
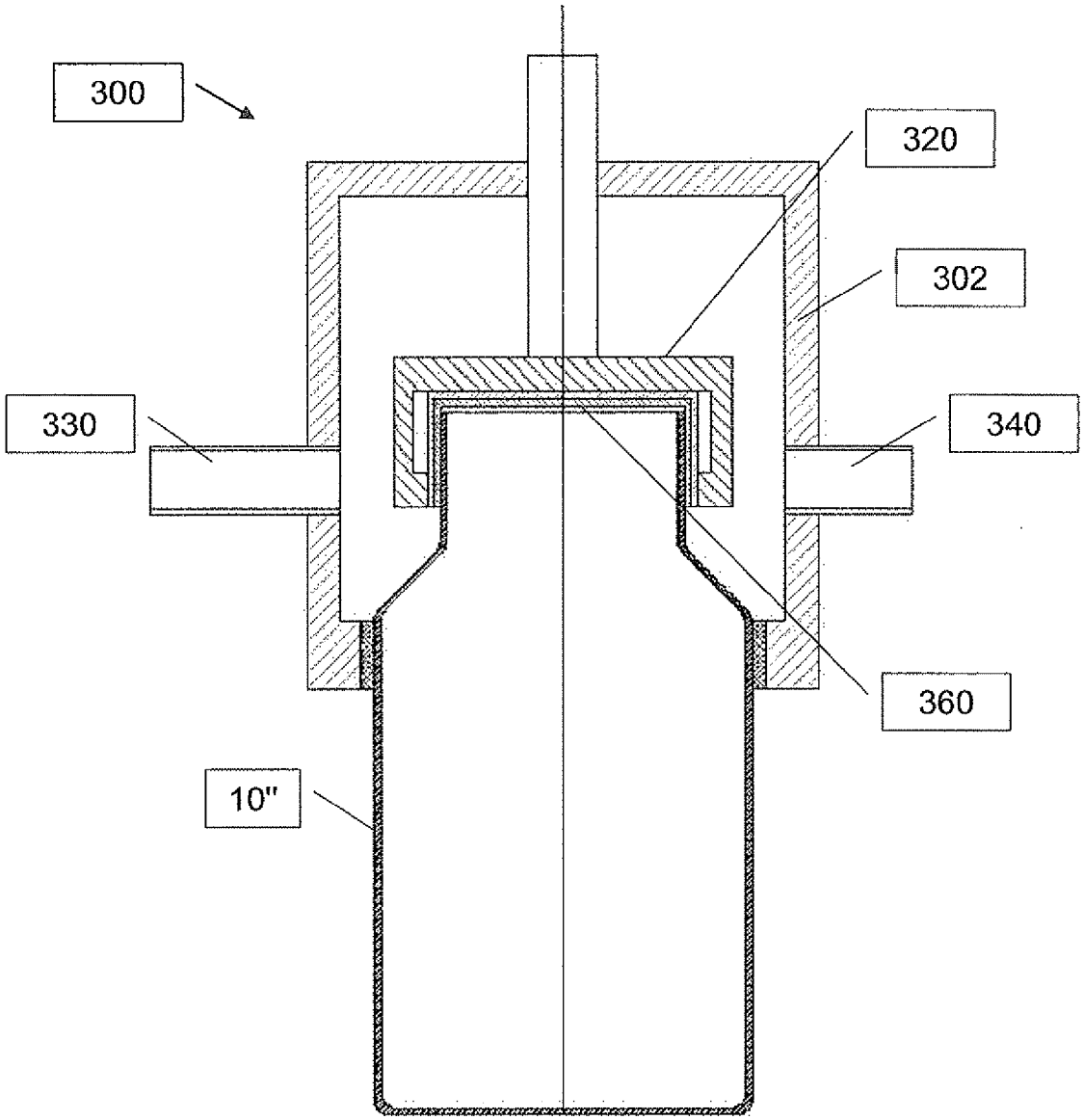
FIG. 15 is a schematic representation of the sealing process of the embodiment of FIG. 13.

The third preferred embodiment of closure head system 100 of the present invention, in which the sealing element is configured for attachment on the container prior to deployment of the closure head, is illustrated in FIGS. 13-16B. Also illustrated in FIG. 13 are non-limiting examples of a rigid container 10" and a full cap 320. As above in the embodiment of FIG. 6A, cap 360 is configured for sealing rigid container 10".

Also similar to the embodiment of FIG. 6A, closure head system 300 includes a closure head housing 302 defining within it an interior volume 304. is configured with a container receiving opening 310, an outlet port 330 and an inlet port 340. The variation from the system of the embodiment of FIG. 6A is that bonding head 120 is replaced by a cap press 320 that is configured to hold and then install cap 360 on container 10" after completion of the desired atmosphere modification. Therefore, cap press 320 is configured on container-sealing mechanism 322.

The basic principles of operation of the embodiment of FIG. 13 are the same as those of the embodiment of FIG. 6A, therefore, FIGS. 14-16B are provided to illustrate the steps of atmosphere modification of this embodiment.

Figure 16B:
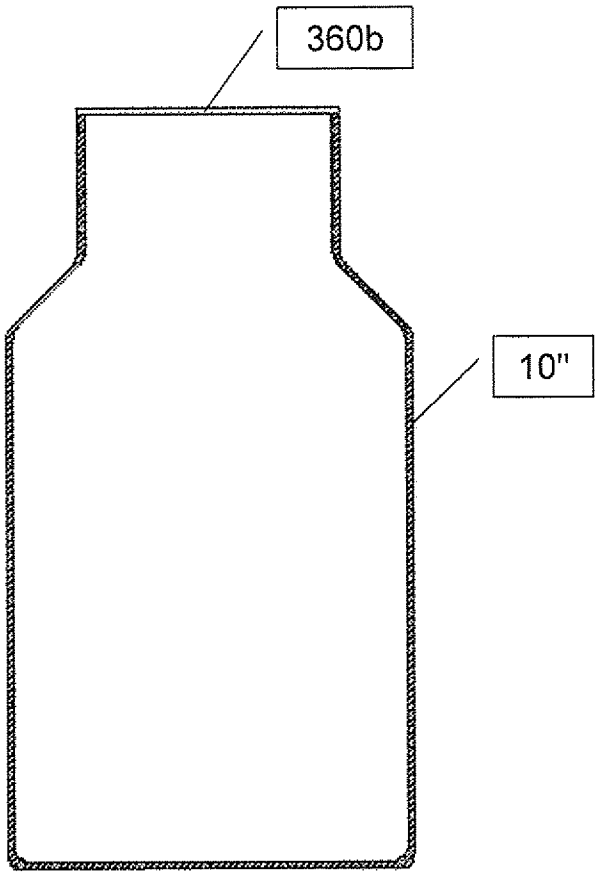
FIG. 16B is a schematic representation of container of FIG. 13 after removal of the cap of the embodiment of FIG. 13.
Figure 16A:
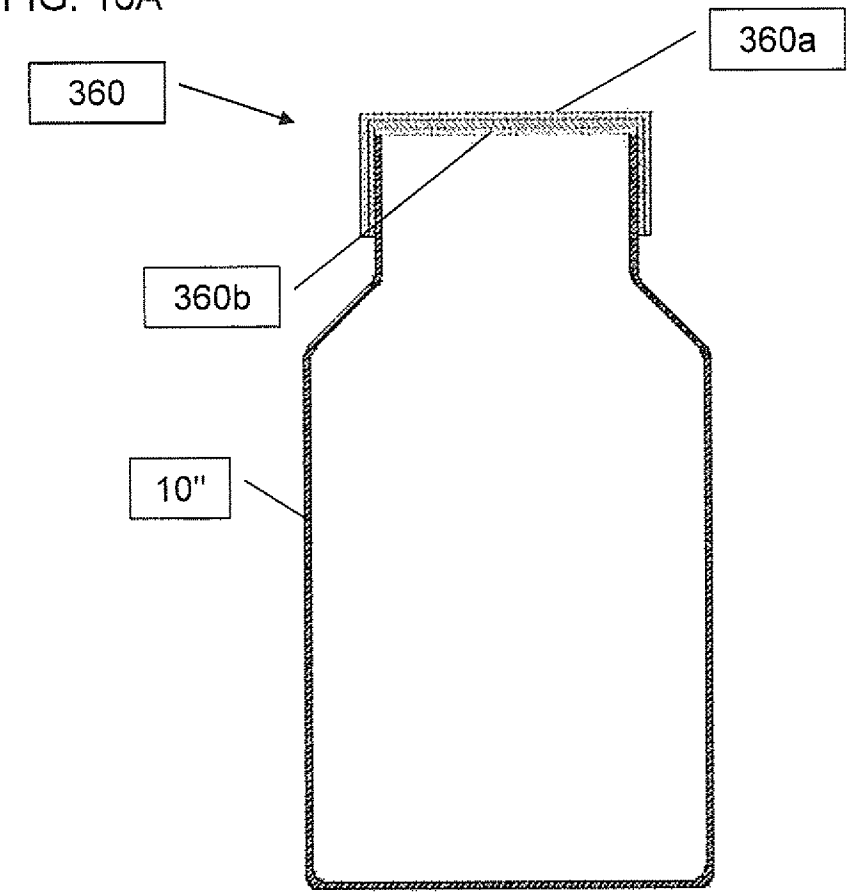
FIG. 16A is a schematic representation of container of FIG. 13 after completion of the sealing process of the embodiment of FIG. 13.

As mentioned above, the notable difference is the sealing of container 10" with a full cap 360. As best illustrated in FIGS. 16A and 16B, cap 360 is configured as an outer cap 360*a* and an inner container seal 360*b*. After capping, and thereby sealing, container 10" it is delivered to the end purchaser with cap 360 is place on container 10". Upon initial removal of outer cap 360*a*, inner container seal 360*b* remains attached to container 10" as a tamper indicator to be removed by the end purchaser.

Figure 17:
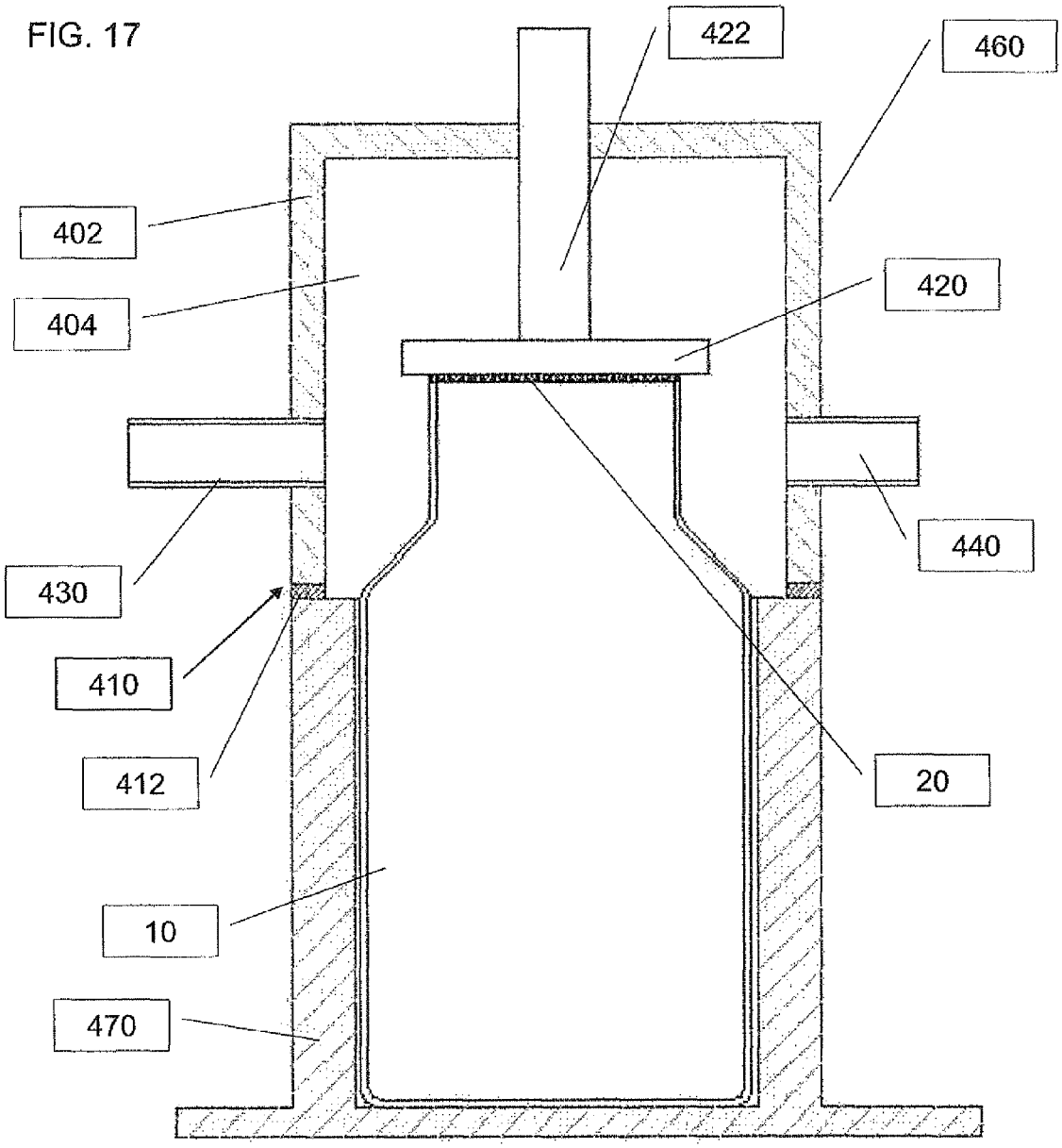
FIG. 17 is a schematic representation of a fourth preferred embodiment of a system for atmosphere modification in a rigid container during the sealing process constructed and operational according to the teachings of the present invention.

FIG. 17 illustrates a fourth preferred embodiment 400 for the atmosphere modification process of the present invention. This embodiment is similar to the embodiment of FIG. 1 and therefore the illustration here relates to after the non-permeable sealing element 20 has been attached to the rigid container 10.

While the operation of the closure head 402 is the same as in the embodiment of FIG. 1, it will be noted that the container receiving opening 410 is now configured for abutment with a container holder 470. As above, such abutment creates an airtight seal isolating the interior volume 404, with the container 10 inside, from the ambient atmosphere. Here also, to further ensure an airtight seal between the container holder 470 and the closure head housing 402, the container receiving opening 410 may be fitted with a resilient contact element 412.

IT will be readily understood that closure head 402 may be implemented such that container-sealing mechanism 422 and bonding head 420 are configured as substantially any combination of container-sealing mechanism and bonding head herein described.

The atmosphere modification described above helps to better preserve the product within the package; however, in order to preserve a product within a package an inflexible or rigid package is preferable. Such a package will not collapse under low atmospheric pressure and will prevent the re-introduction of oxygen and moisture into the package by diffusion through the package lining and back inside the package.

Therefore, the atmosphere modification method of the present invention, which removes the harmful air and replaces it with an inert gas that does not affect the environment or the product, prevents the container's collapse and also prevents the introduction of moisture and oxygen back into the package because of the positive pressure in the package.

It will be appreciated that a special meter may be used to measure the pressure or vacuum level within a closed container, especially a rigid container such as a bottle, for example.

The meter is configured so as to screw onto the container and block the valve area. The meter also includes a hollow needle that is inserted into the bottle through the non-permeable sealing element used to seal the container, such as sealing element 20 shown in FIG. 1. The goal of this measuring is to monitor, over time, the stability of the pressure/vacuum inside the bottle.

It will be appreciated that the above descriptions are intended only to serve as examples, and that many other embodiments are possible within the spirit and the scope of the present invention.

What is claimed is:

1. A method for atmosphere modification in a filled container during the sealing process, the container having a container-opening for insertion and removal of contents of the container, the method comprising:

(a) attaching a sealing element on the container, the container being implemented as a rigid container, so as to close the container opening, said sealing element configured with at least two layers so as to provide a passageway having at least a first opening open to the interior region of the container and at least a second opening open to the outside of the container;

(b) deploying a closure head on the container so as to enclose at least said second opening, so as to create an air-tight seal such that an interior volume of said closure head is isolated from the ambient atmosphere, said closure head implemented so as to have at least one conduit in fluid communication between said interior volume and at least one of:

(A) a vacuum source;

(B) a pressure source;

(c) creating at least a partial vacuum inside the container, (d) inserting a replacement atmosphere into the container by means of said pressure source;

(e) bonding together at least a portion of said at least two layers of said sealing element so as to close said passageway, thereby sealing the container; and (f) removing said closure head from the container.

2. The method of claim 1, wherein said deployment of said closure head brings said closure head into direct contact with the container.

3. The method of claim 1, wherein said bonding together said least a portion of said at least two layers of said sealing element includes bringing a bonding head into contact with a top layer of said sealing element so as to close said passageway.

* * * * *